United States Patent [19]

Stenlund

[11] 4,389,150

[45] Jun. 21, 1983

[54] APPARATUS FOR MOVABLY SPREADING MATERIAL ON A RAILROAD EMBANKMENT

[75] Inventor: Rune Stenlund, Askersund, Sweden

[73] Assignee: AB Vretstorp-Verken, Vretstorp, Sweden

[21] Appl. No.: 144,821

[22] Filed: Apr. 29, 1980

Related U.S. Application Data

[63] Continuation-in-part of Ser. No. 870,366, Jan. 18, 1978, abandoned.

[30] Foreign Application Priority Data

Jan. 25, 1977 [SE] Sweden ..... 77007700

[51] Int. Cl.[3] ..... B60P 1/36; B60P 1/58

[52] U.S. Cl. ..... 414/505; 414/525 A

[58] Field of Search ..... 414/502–505, 414/523, 525 R, 525 A, 528; 239/156, 656, 659, 664; 171/16

[56] References Cited

U.S. PATENT DOCUMENTS 1,922,447 8/1933 Miller et al. ..... 414/525 R 2,564,020 8/1951 Mengel ..... 414/523

3,429,418 2/1969 Fyrk ..... 239/656

*Primary Examiner*—Robert G. Sheridan

*Attorney, Agent, or Firm*—Sherman & Shalloway

[57] ABSTRACT

Two funnel troughs which function as containers are supported on a carriage of a moving railway vehicle. The troughs contain one or more materials which may be combined in a central funnel from which the material is to be spread upon a railroad embankment adjacent railroad tracks along which the vehicle will traverse. The troughs open downwardly into two vibrating feeders. The feeders supply the materials through a funnel to a conveyor belt. The conveyor belt is mounted on a turntable and can rotate to either side of the vehicle so that the material can be spread at an adjustable distance from the tracks to either embankment located along the path of travel. The vibrating frequency of the feeders and the speed of the conveyor belt are adjustable according to the speed with which the vehicle is traversing the tracks. The feeders are so designed to permit doorless operation of the troughs for discharging the material. The operations of the apparatus may be controlled from a location remote from the spreading mechanism.

8 Claims, 2 Drawing Figures

APPARATUS FOR MOVABLY SPREADING MATERIAL ON A RAILROAD EMBANKMENT

This application is a continuation in part of copending application Ser. No. 870,366 filed Jan. 18, 1978, now abandoned.

BACKGROUND OF THE INVENTION

1. Field of the Invention

The invention relates to an apparatus for the transport and spreading of ballast and bench material for the maintenance of railroad embankments.

2. Description of the Prior Art

Railbound conventional carriages for transporting and spreading macadam and other materials for the maintenance of railroad embankments are provided with discharge doors which are manually opened. With such prior art carriages it is difficult to adjust the spread capacity so as to obtain a uniform spread of the material. Moreover, the door control during the operation involves the risk of accidents. Therefore, a special plough is required to level the non-uniformly spread material.

Typical prior art devices are disclosed in U.S. Pat. No. 1,922,447 to Miller et al., U.S. Pat. No. 2,564,020 to Mengel, and U.S. Pat. No. 3,429,418 to Fyrk. None of these references disclose a moving apparatus for spreading a strand of material adjacent a railroad track. Miller et al., U.S. Pat. No. 1,922,447, disclose a point-to-point transfer means, utilizing detachable, hinged chutes and having a reciprocating feed utilizing feed-plates with variable stroke in order to accommodate different materials. The material is delivered through chutes 10 which are hinged and thus require manual supervision of positioning, in order to assure delivery to a waiting receptacle 12. Delivery is made while the device is stationary.

Mengel U.S. Pat. No. 2,564,020 similarly teaches a point-to-point delivery vehicle, providing stationary discharge of material via a hopper having manually operable discharge doors, or valves on the hopper, to a waiting receptacle, such as a van, for example. The disclosure provides a combination of a turntable and a conveyor, but does not provide any indication of the use of a central funnel, capable of receiving materials from two separated troughs by vibrating means for movable, doorless distribution of a strand of the material along a railroad track. In fact, the use of a forward supporting leg 110 is required, enabling the equipment to be operated only when the vehicle is positioned at the point of discharge. The conveyor is required to be manually positioned, and the valve must be manually opened prior to operation.

Fyrk, U.S. Pat. No. 3,429,418 is yet another teaching of an apparatus for delivery of material to a predetermined point. Such delivery is achieved with the aid of a worm gear, or auger, supported by hooks and chains and requiring manual stabilization for delivery. Additionally, delivery by the worm gear is from a single hopper rather than from a pair of troughs. Where the patented apparatus is to function as a spreader, the worm gear conveyor is not used. Rather, a ballast spreading arrangement is described, with an impeller requiring a complex structure. While the amount of material spread may be corelated with the vehicle speed, it is clear that any blending of materials to be spread requires the use of two conveyors to carry the materials to a chute guiding the materials to the rotating impeller disc.

The present invention accordingly overcomes the disadvantages of the prior art by providing an apparatus for dispensing materials, preferrably during movement of the device along railroad tracks, from a pair of troughs feeding a conveyor via adjustable vibrating feeders and through a central funnel which permits blending of several materials. The conveyor is mounted on a turntable, and the entire apparatus may be remotely controlled and adjusted, without requiring manual adjustments of the several components thereof.

SUMMARY OF THE INVENTION

A carriage according to the invention for transporting and spreading ballast and bench material for the maintenance of railroad embankments and the like more precisely is characterized in that it comprises a carriage body mounted on a railway vehicle. The carriage supports two funnels which, in relation to the transverse central line of the carriage and vehicle, are located symmetrically relative to each other. Each funnel opens to a dispensing means which comprises a vibrating feeder directed obliquely downward to the carriage transverse central line. The feeders discharge material via a central funnel onto a belt conveyor, which is rotatable to both sides from the carriage longitudinal central line. The dispensing means is designed to permit the use of funnels having no manually operated doors.

It is an object of the invention to provide an apparatus for spreading material on a railroad embankment which is capable of spreading the material on either side of the embankment in an even manner, at a predetermined, adjustable distance, so as not to require a plow to level the material.

It is a further object of this invention to provide an apparatus for spreading material on a railroad embankment which makes use of funnel troughs to contain the material to be spread, and vibratory feeders to supply the material from the funnel troughs to a conveyor belt for spreading onto the railroad embankment.

It is yet another object of the invention to provide an apparatus for spreading material on a railroad embankment which uses a central funnel to combine several materials prior to delivery to a conveyor means for discharge to the embankment.

It is still another object of the invention to provide a centrally controlled apparatus for spreading material on a railroad embankment, wherein vibratory feeders and a conveyor are adjustable in accordance with the vehicle speed to supply the material uniformly even when the speed of the dispensing vehicle is not constant.

It is a further object of the invention to provide a vehicle for dispensing material on a railroad embankment wherein doorless troughs are used to contain the material to be spread.

BRIEF DESCRIPTION OF THE DRAWINGS

These features and objects of the invention will become apparent to those skilled in the art by referring to the following description and accompanying drawings in which.

DESCRIPTION OF THE PREFERRED EMBODIMENT

Figure 1:
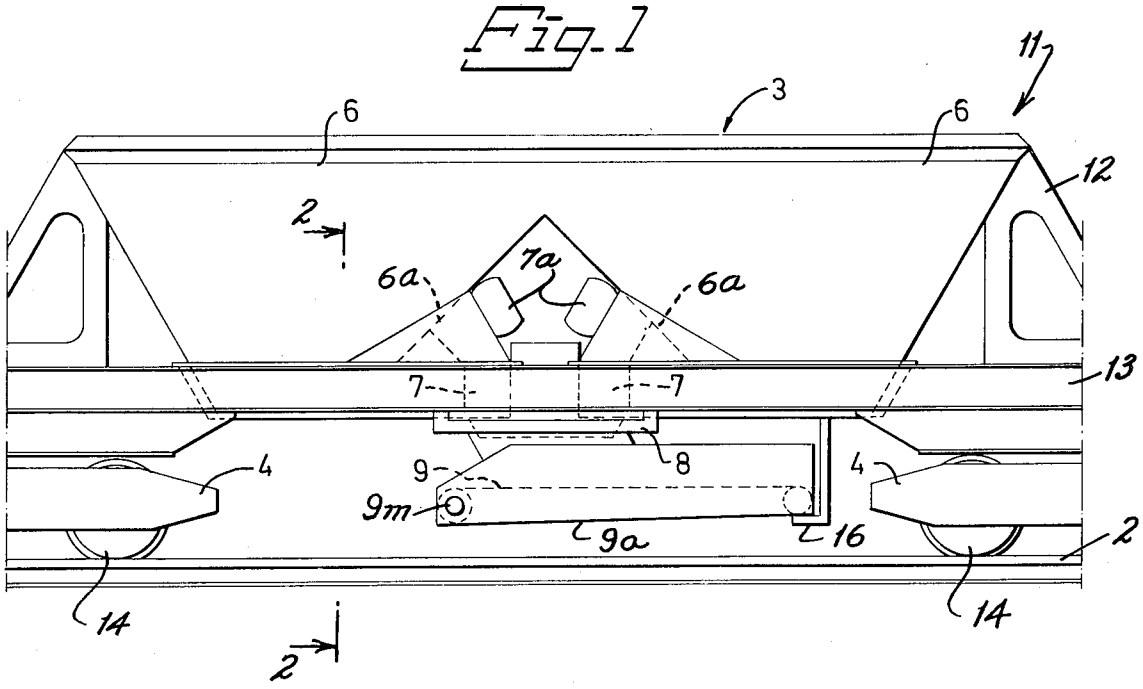
FIG. 1 is a side view of a railway vehicle carrying the disclosed invention with the conveyor in a longitudinal storage position.

Railroad bench 1 includes an embankment 1*a* and support rails 2 which allow a railway vehicle 11 to travel. The railway vehicle 11 has a housing and support system which is comprised of a carriage 3 which is supported by supports 12 connected to frame 13. Frame 13 is connected to bogies 4 which include wheels 14. The carriage 3 includes a carriage body 5 which supports two funnel troughs 6 which are containers with apertures 6*a* for supplying a material to be spread on the embankment 1*a*. The funnel troughs 6 are located symmetrically relative to each other in comparison to the transverse central line of the vehicle.

Below each funnel trough and supported by the frame 13 is a dispensing means for the material, which includes a vibratory feeder 7 and an endless conveyor belt 9. The dispensing means may be so designed to permit use of funnels without any manually operated locking doors. Specifically, the dispensing means prevents, in its non-operative state, the materials in the hoppers from dropping through the funnels to the vibratory feeder, and permits, in its operative state, a steady and adjustable flow to the conveyor.

The feeders 7 supply the material located in the funnels 6 by vibration movement to a central funnel 8 located centrally below the feeders 7 and beneath the carriage 3 and attached to the housing and frame 13. Endless conveyor belt 9 extends below the funnel 8 to receive the supplied material and to carry the material for deposit onto the embankment 1*a*.

The feeders 7 of the vehicle 11 may be of any vibratory type which, via the central funnel 8, are capable of feeding the material onto the conveyor belt 9. The feeders have vibrating means 7*a* powered by any convenient means such as hydraulic, pneumatic or electric power. Basically, the feeder can be a sloped pan which adjustably vibrates side to side, up and down or front to back via resilient means 15 causing the material deposited on the pan to move and flow downward. The conveyor belt 9 is connected and supported to the frame 13 by housing 9*a*. The housing 9*a* is united with the frame 13 by any convenient rotating system such as a turntable 10 or flanged arrangement which allows the housing 9 to rotate. This allows the placement of the conveyor belt 9 on either side of the vehicle 11 so that the embankment 1*a* or its opposing embankment (not shown) can be supplied with the material carried by the funnels 6.

The belt of the conveyor 9 is supplied with a motor 9*m* which allows the belt to rotate at an adjustable speed. The motor 9*m* is powered by any convenient source. In order to be compatible with the adjustable speed of the belt conveyor 9, the vibratory feeders 7 are similarly provided with a vibrating means 7*a* which has a frequency of vibration which is adjustable.

Figure 2:
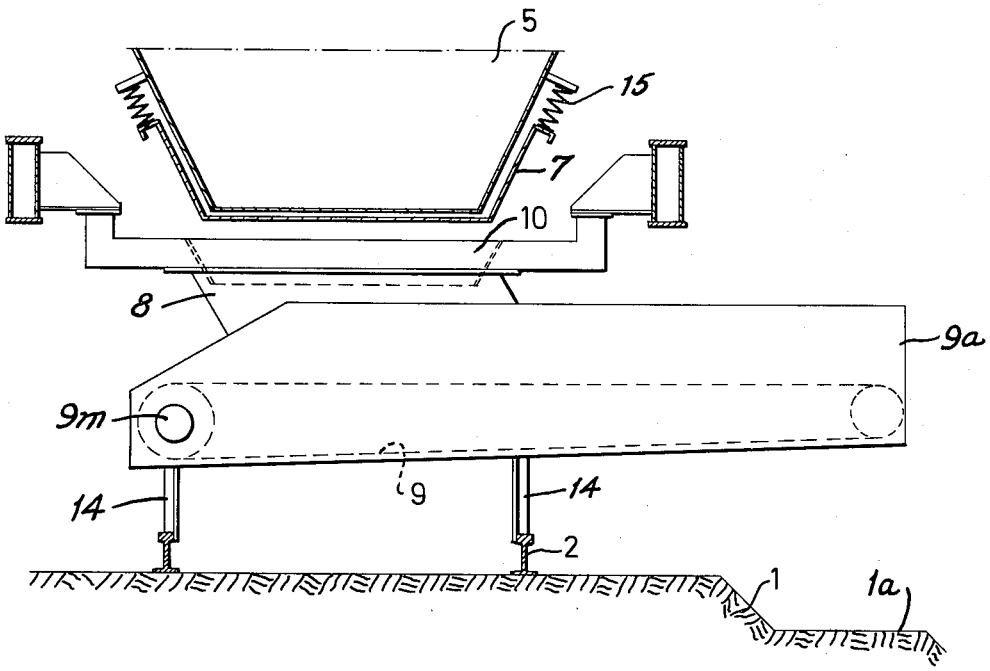
FIG. 2 is a cross-section of the railway vehicle in FIG. 1 taken along line 2—2 of FIG. 1 with the conveyor in a transverse operating position.

In FIG. 1, the conveyor belt 9 is shown in a parallel position as compared to the vehicle 11. This is the longitudinal storage position for the conveyor 9 and the end of the conveyor is retained in a support 16. In FIG. 2, the conveyor belt 9 is shown in the transverse operating position to supply material to the embankment 1*a*. Actually, the position of the conveyor belt 9 in FIG. 2 is as if it was rotated 90° as compared to the position of the conveyor belt 9 in FIG. 1.

As shown in FIG. 2, the housing 9*a* for the conveyor belt 9 is connected to the frame 13 via turntable 10. The turntable may be powered by a convenient source and allows the conveyor belt to rotate with respect to the vehicle.

The belt of the conveyor 9 and the feeders 7 can have adjustable speed so that the discharge of material can be adjusted with movement of the carriage along the track. The material to be spread, such as macadam, can be laid in uniform strands in optional remotely controllable positions from the center of the track and up to 1.8 m to both sides from the track. The carriage is controlled from a control panel (not shown), so that the desired feed capacity for the spread of material can be obtained at any given time. The control panel may include controls for the vibrating frequency of the vibratory feeders 7 and for the belt speed of conveyor 9. The controls, as above described, may be responsive to carriage movement, including, for example, carriage velocity. Gravel and unscreened filler material can be controllably spread over a width of from 0.8 m from the track center up to 2.3 m therefrom. An embodiment of the vehicle 11 according to the invention has a body of a volume of 36 $m^3$, the vibratory feeders have a capacity of 650 $m^3/h$, and the rotary conveyor has a belt width of 1.2 m. At operation from the control panel, first a conveyor safety mechanism is released, after which the conveyor is started and turned to the desired lateral position. Thereafter, the vibratory feeders are started, and the desired capacity is chosen.

The vehicle 11 according to the invention can run at the speed of 90 km/h, so that the driving time to the desired place is rather short. The material, furthermore, can be discharged at a substantially shorter time than with known carriages. This is particularly valuable, because the railroad track in question often is available for material spread only for short periods, in view of the ordinary railway traffic.

Material deposited in the funnels 6 is supplied through apertures 6*a* in the lower portions of the funnels to the vibratory feeders 7. Depending on the frequency and wavelength of the vibration imposed by the vibrating means 7*a* to the vibratory feeders 7, the material is caused to move by vibration and gravity and to the central funnel 8 which guides the material onto the conveyor belt 9. The conveyor belt motor 9*m* turns the conveyor belt and causes the material to be carried along the length of the conveyor belt. The material drops off the end of the conveyor belt for deposit onto the embankment 1*a*.

Various changes may be made in the details of the invention as disclosed without sacrificing the advantages thereof or departing from the scope of the appending claims. Furthermore, although the present invention has been disclosed and discussed with particular regard to the exceptional advantages in terms of its application to railway embankment maintenance, it may be understood by one skilled in the art that the invention may be employed in several industrial applications wherein the spreading of the material is required.

What is claimed is:

1. A railway vehicle for discharging a strand of material while moving on railroad tracks, comprising:

(a) first and second funnel troughs for retaining the material;

(b) housing and support means for supporting the first and second troughs on the railroad tracks;

(c) dispensing means for controlling the flow of and dispensing said material in a strand spaced apart from said railroad tracks;

(d) said dispensing means comprising an endless belt conveyor attached to said housing and support means for conveying the material to a discharge opening;

(e) said dispensing means further comprising vibratory feeding means operated at a pre-determined vibratory frequency and located below each of said first and second funnel troughs and connected to said housing and support means, said troughs each having an aperture therein for supplying the material to said vibratory feeding means;

(f) a central funnel attached to said housing and support means, said central funnel located between each of the vibratory feeding means corresponding to the apertures in the first and second troughs and the conveyor means for supplying the material from said first and second troughs via said vibratory feeding means to said conveyor; and (g) a means to adjust the rate of discharge of the material for a selected control setting by changing the speed of the conveyor and the vibratory frequency of the vibratory feeding means in accordance with the velocity of the railway vehicle on the railroad tracks, thereby spreading the material uniformly, despite changes in the velocity of the railway vehicle, whereby said conveyor belt cooperates with said vibratory feeding means to control the discharge of said materials.

2. The apparatus of claim 1 wherein said central funnel comprises means for blending different materials from said first and second funnel troughs.

3. An apparatus as recited in claim 1 wherein said dispensing means is adjustable for dispensing said strand of material at an adjustable distance from said tracks.

4. An apparatus as recited in claim 1 wherein said first and second funnel troughs comprise doorless hoppers, and wherein said dispensing means further functions, when not operating, to prevent the material in said troughs from exiting.

5. An apparatus as recited in claim 1 wherein said conveyor means is attached to said housing and support means via a turntable which allows said conveyor to rotate with respect to said housing.

6. An apparatus as recited in claim 1 wherein said strand may be discharged on an embankment adjacent said railroad tracks.

7. An apparatus as recited in claim 1 wherein said carriage comprises bogies and wheels for use on said railroad tracks.

8. An apparatus as recited in claim 1 wherein the railway carriage can travel at at least 90 Km/hr.

* * * * *